United States Patent [19]

Kinloch

[11] Patent Number: 4,470,214

[45] Date of Patent: Sep. 11, 1984

[54] DISPLAY SIGN FOR AUTOMOTIVE VEHICLES

[76] Inventor: Clary M. Kinloch, 3930 Broad River Rd., Village Green Apt. #U4, Columbia, S.C. 29210

[21] Appl. No.: 520,613

[22] Filed: Aug. 5, 1983

[51] Int. Cl.[3] ..... G09F 21/14

[52] U.S. Cl. ..... 40/593; 40/365

[58] Field of Search ..... 40/541, 543, 591, 593, 40/555, 365

[56] References Cited

U.S. PATENT DOCUMENTS

| | | | |
|---|---|---|---|
| 2,194,819 | 3/1940 | Book | 40/555 |
| 3,014,123 | 12/1961 | Mainzer | 40/555 |

FOREIGN PATENT DOCUMENTS

| | | | |
|---|---|---|---|
| 615957 | 7/1935 | Fed. Rep. of Germany | 40/541 |
| 663398 | 8/1938 | Fed. Rep. of Germany | 40/541 |
| 1149205 | 12/1957 | France | 40/541 |
| 1225356 | 6/1960 | France | 40/591 |
| 1528591 | 10/1978 | United Kingdom | 40/591 |

*Primary Examiner*—Gene Mancene

*Assistant Examiner*—Wenceslao J. Contreras

[57] ABSTRACT

This display sign is designed for the rear window area of automobiles, so as to display different posters, which reflect light from their faces. The sign may be used for bumper stickers, and may be used for political campaigning, sports, etc. Primarily, the design consists of a box with a light, which shines on the reflective face of a removable poster, and the box includes a folding frame, which receives one poster at a time.

1 Claim, 5 Drawing Figures

Fig. 1
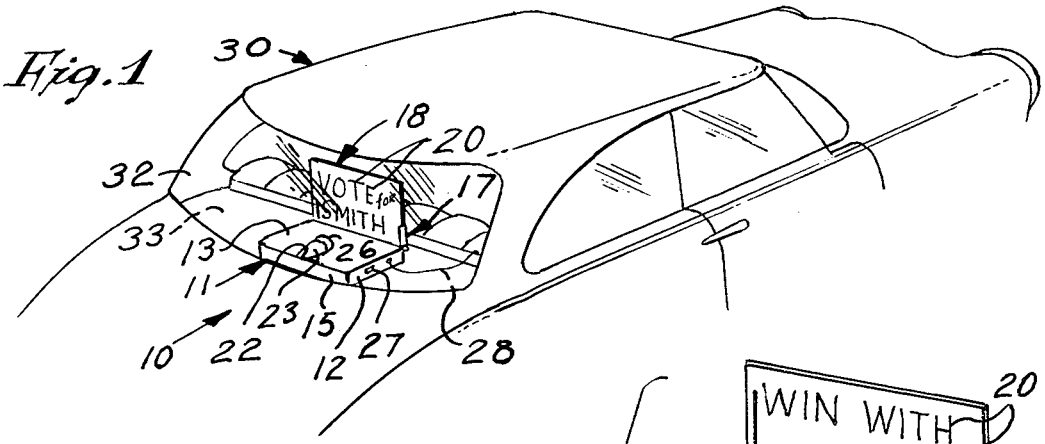
Fig. 2
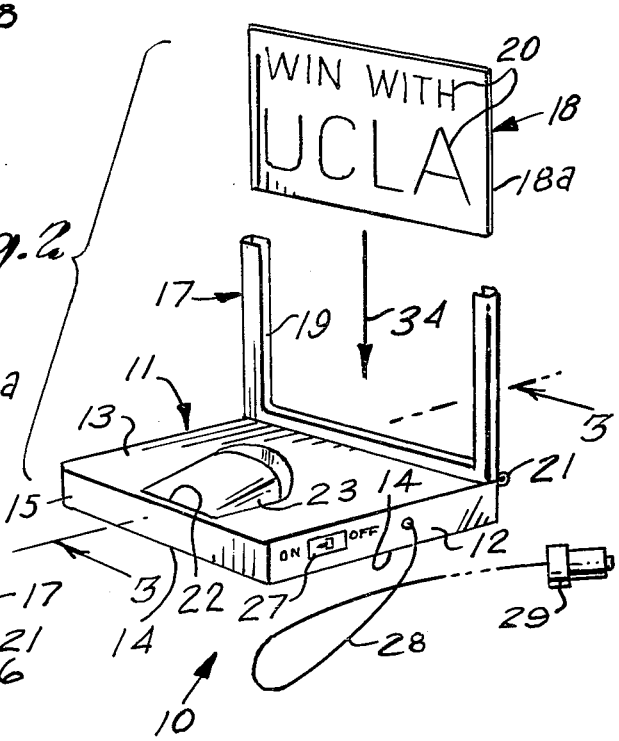
Fig. 3
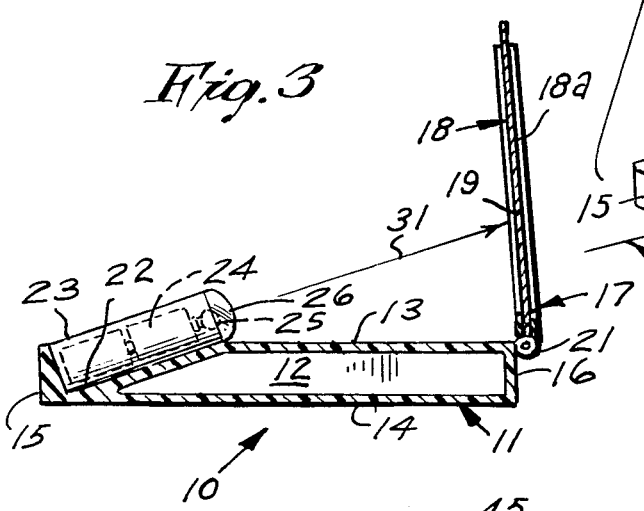
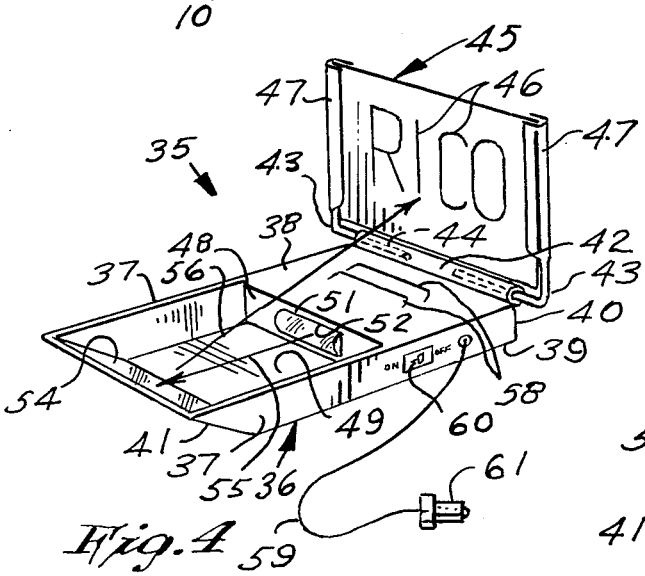
Fig. 4
Fig. 5
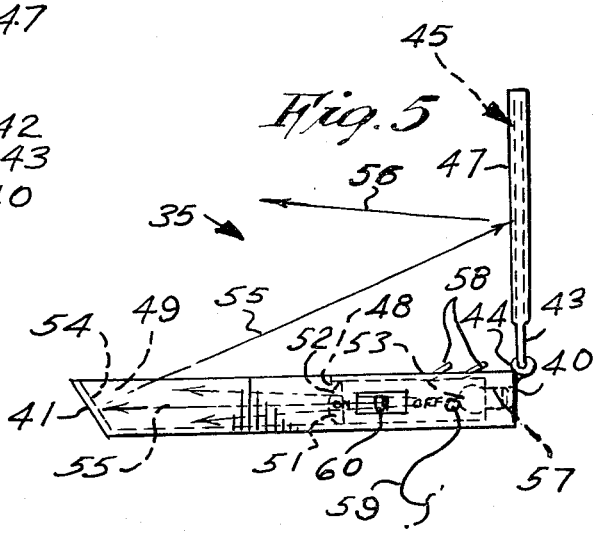

DISPLAY SIGN FOR AUTOMOTIVE VEHICLES

This invention relates to signs, and more particularly, to a display sign for automotive vehicles.

The principal object of this invention is to provide a display sign for automotive vehicles, which will be unique, in that it will be employed in the rear of a vehicle, so as to display information, such as schools, solicitation, campaigns, drawings, etc.

Another object of this invention is to provide a display sign for automotive vehicles, which will be electrical, and will glow at night, and also in the daytime, and will be placed in the rear window area, so as to be viewed from behind the vehicle by other drivers.

Another object of this invention is to provide a display sign, which will be of such construction, that only the removable display poster of the device will be seen, which contains the information to be read.

A further object of this invention is to provide a display sign, which will include an adapter on its cord, so as to be plugged into the cigarette lighter receptacle of a vehicle, and the sign will enable the user to display information whenever he feels like it.

A still further object of this invention is to provide a display sign, which will be fabricated in boxlike form that may be fabricated in different sizes, so as to be adapted to automotive vehicles of different styles, and the sign will also serve as a night light, when desired.

Other objects are to provide a display sign for automotive vehicles, which is simple in design, inexpensive to manufacture, rugged in construction, easy to use, and efficient in operation.

dr

These, and other objects, will be readily evident, upon a study of the following specification, and the accompanying drawing, wherein:

FIG. 1 is a perspective view of the present invention, shown installed in a vehicle, which is illustrated fragmentary;

FIG. 2 is an enlarged perspective view of the invention, shown removed from the vehicle, and illustrates one display slide or card position for being received therein;

FIG. 3 is a cross-sectional view, taken along the line 3—3 of FIG. 2;

FIG. 4 is a perspective view of a modified form of the invention, and

FIG. 5 is an enlarged side elevational view of FIG. 4.

Accordingly, a display sign 10 is shown to include a box 11, having a pair of side walls 12, a top wall 13, a bottom wall 14, a front wall 15, and a rear wall 16. A hinged channel member 17 is provided, and is of "U"-shape, and is also "U"-shaped in cross-sectional configuration, for removably receiving a reflective poster 18, or the like, which is slideably received in the groove 19. Poster 18 is imprinted with letter characters 20, which are of a suitable reflective material known in the art, for a purpose which hereinafter will be described. Channel member 17 includes a hinge 21, which is fixedly secured to its bottom longitudinal edge in a suitable manner. Hinge 21 is also fixedly secured to the rear wall 16 in a suitable manner, so as to pivot member 17 towards the front of box 11, which is fabricated of plastic or other suitable material, as is channel member 17, and poster 18 will be made of plastic or other suitable material, also, and its rear face 18*a* will be opaque, so as to prevent light from passing through. The letter characters 20, or drawing, not shown, may be imprinted onto a self-adhesive sheet of material, that will be applied to the front of poster 18, and will have reflective glitter material applied, or the poster may have available bumper stickers applied thereto, to convey any message desired.

An inclined recess opening 22 is provided in the front portion of top wall 13, which receives a flashlight housing 23, and housing 23 is typical of the art, and includes batteries 24, a bulb 25, and a lens and reflector assembly 26. The sign 10 also includes an on-off switch 27, which is suitably mounted in a side wall 12, so as to turn sign 10 on and off, as desired. An electric cord 28 is also included, which has an attached adapter plug 29, for insertion into the cigarette lighter receptable of vehicle 30, when not using the batteries 24 of housing 23, and the degree of angle of opening 22 is such, that the light produced will travel at an angle, as indicated by arrow 31, which causes the reflected light, from the characters 20, to travel rearward through the rear window 32 of vehicle 30.

In use, box 11 is placed on surface 33, adjacent to rear window 32 of vehicle 30, and the channel member 17 is pivoted upwards by means of hinge 21. After the abovementioned, any desired poster 18 is dropped into groove 19 of channel member 17, as is indicated by the arrow 34 means, and it should be noted, that the opaque and dark surface 18*a* of poster 17 will be facing towards the front of the vehicle 30. The switch 27 is then turned on when desired, night or day, which causes the light from housing 23 to be directed onto the characters 20, which will reflect their intended message through the rear window 32, where it may be easily read by following drivers, or pedestrians, when the vehicle 30 is at a standstill. When desired, or when batteries 24 are exhausted, the adapter 29, of cord 28, is plugged into the vehicle's cigarette lighter receptacle, for power.

It shall also be noted, that the light produced for sign 10 may be of different colors, as desired.

Referring now to FIGS. 4 and 5 of the drawing, a modified form of sign 35 is shown to include a box 36, having a pair of side walls 37, a top wall 38, a bottom wall 39, an end wall 40, and an inclined end wall 41, all of which are secured together in a suitable manner. A sleeve 42 is fixedly secured, in a suitable manner, to an edge of end wall 40, and a pair of "L"-shaped pins 43 are received at one end, in an end opening 44 of sleeve 42, so as to serve as a hinge for poster 45, having reflective letter characters 46, which are similar to characters 20, heretofore described of poster 18. A channel member 47, of "U"-shaped cross-sectional configuration, is fixedly secured, at one end, in a suitable manner, to the extending end of each of the pins 44, and members 47 freely and slideably receive poster 45. Top wall 38 extends partially towards the center of box 36, and an intermediate wall 48 is fixedly secured to the edge of top wall 38, and is fixedly secured to bottom wall 39, and side walls 37, which defines an opening 49, and a compartment 50. A magnifying lens 51 is fixedly secured within a cut-out opening 52 in wall 48, and serves to project light from bulb 53 to mirror surface 54 of end wall 41, which is indicated by the arrow 55. The light reflected is then projected, at an angle, to the letter characters 46 of poster 45, as is indicated by the arrow 56 means. Bulb 53 is suitably secured within an opening 57 through end wall 40, and a pair of open louvres 58, in top wall 38, serve to ventilate compartment 50, to release the heat from bulb 53. Bulb 50 is electrically connected to cord 59, which is wired in series with on-off switch 60, that is fixedly secured in one of the side walls 37, and an adapter 61 is provided on the end of cord 59, so as to be received in the vehicle's cigarette lighter for power.

In use, box 36 is placed in vehicle 30, in the same manner, as was heretofore described of box 11 of sign 10, and a poster 45 is placed within channel members 47, with the letter characters 46 facing in the direction of the mirror surface 54. The adapter plug 61 is placed in the cigarette lighter receptacle and the switch 60 is turned on, which causes light to emit from bulb 53, and strike mirror surface 54, where it will reflect onto poster 45, and be reflected therefrom, as indicated by the arrow 56.

While various changes may be made in the detail construction, it is understood that such changes will be within the spirit and scope of the present invention, as is defined by the appended claims.

What I now claim is:

1. A display sign for automotive vehicles, comprising, in combination, a rectangular, relatively low box, having a top wall only at one end thereof, and being open on top at its opposite end, said box including a transverse wall, which, together with said top wall, defines an enclosure at said one end, an electric lamp inside said enclosure, and an on-off switch on an outer side of said box in an electric circuit with an external extension cord from said box, for connection to a cigarette lighter power source of an automotive vehicle, a pair of lamp heat ventilating louvers on said top wall, a magnifying lens set in an opening through said transverse wall, an end wall at said box opposite end being angularly inclined, and having a mirror surface, a "U"-shaped channel hinged upon said one end of said box, a removable poster receivable in said channel, and said lamp, lens, mirror surface and poster being aligned for light rays from said lamp projecting on said poster.

* * * * *